US005333754A

United States Patent [19]

Kobayashi

[11] Patent Number: 5,333,754

[45] Date of Patent: Aug. 2, 1994

[54] SHELF FOR HOUSING PRODUCTS IN AN AUTOMATIC FROZEN-PRODUCT VENDING MACHINE

[75] Inventor: Tatsuya Kobayashi, Kawasaki, Japan

[73] Assignee: Fuji Electric Co., Ltd., Kawasaki, Japan

[21] Appl. No.: 101,028

[22] Filed: Aug. 3, 1993

[30] Foreign Application Priority Data

Aug. 19, 1992 [JP] Japan ..... 4-242694

[51] Int. Cl.[5] ..... G07F 11/46

[52] U.S. Cl. ..... 221/75; 221/150 R; 221/286; 221/312 R; 221/197

[58] Field of Search ..... 221/75, 150 R, 123, 221/124, 130, 131, 133, 200, 258, 277, 286, 312 R, 193, 194, 195, 196, 197

[56] References Cited

U.S. PATENT DOCUMENTS

| | | | |
|---|---|---|---|
| 1,431,437 | 10/1922 | Wisroth | 221/150 R X |
| 2,036,970 | 4/1936 | Porter . | |
| 2,041,089 | 5/1936 | Rowe | 221/133 X |
| 2,073,698 | 3/1937 | Kalbitzer, Jr. . | |
| 2,140,587 | 12/1938 | Kalbitzer, Jr. . | |
| 3,908,858 | 9/1975 | Wirstlin et al. | 221/75 |
| 3,986,637 | 10/1976 | Wittern et al. | 221/75 |
| 4,930,663 | 6/1990 | Ficken | 221/75 |
| 5,064,092 | 11/1991 | Grossi | 221/75 |

FOREIGN PATENT DOCUMENTS

| | | | |
|---|---|---|---|
| 0400747 | 12/1990 | European Pat. Off. . | |
| 60-62179 | 5/1985 | Japan . | |
| 62-62388 | 4/1987 | Japan . | |
| 851405 | 10/1960 | United Kingdom . | |
| 1445770 | 8/1976 | United Kingdom | 221/75 X |

*Primary Examiner*—Robert P. Olszewski
*Assistant Examiner*—Dean A. Reichard
*Attorney, Agent, or Firm*—Kanesaka & Takeuchi

[57] ABSTRACT

Frozen products housed in a rack are retained in a spiral wire and is guided by plastic guide pieces formed at portions necessary to hold the products. The guide pieces are fixed onto fitting supports attached to the rack, so that ice deposition spaces are created between the guide pieces and a rack surface (12). Thus, the ice formed in the rack is accumulated in the spaces, thereby reducing its effect on the products. In the invention, damage to the wrapping of a bagged product and deformation thereof are prevented.

5 Claims, 1 Drawing Sheet

SHELF FOR HOUSING PRODUCTS IN AN AUTOMATIC FROZEN-PRODUCT VENDING MACHINE

BACKGROUND OF THE INVENTION AND RELATED ART STATEMENT

The present invention relates to an automatic frozen-product vending machine, and more particularly, to a shelf for housing products in an automatic vending machine in selling ice cream retained in bags.

A shelf for housing products or ice cream has already been known, wherein wrapped ice cream is stacked in a square hollow rack, and upon sale of the ice cream, a spiral wire is rotated at a half turn driven by a motor, and the ice cream is delivered one by one from a lower part of a case. (Japanese Utility Model Laid-open No. 59-08978.)

While such a shelf for housing products avoids problems of damages to the wrapping and deformation of the products due to accumulated ice, ice generally grows on a surface of the shelf, because the shelf is made of a steel sheet. Accordingly, a large number of ribs has been disposed longitudinally on a rack guide face for guiding the products such that the contact area of the rack with the products is reduced (Japanese Utility Model Laid-open No. 59-108978). It would be more effective if these ribs were made of plastic which does not hold ice as easily as steel.

However, if plastic ribs are formed on the entire surface of the rack wall, it causes a trouble of increasing cost.

Accordingly, it is an object of the present invention to minimize the cost of forming plastic ribs, and moreover, to provide a shelf for housing products in an automatic frozen-product vending machine designed for delivering the products smoothly by allowing ice to accumulate only at harmless locations on the rack.

SUMMARY OF THE INVENTION

In order to achieve the above objects, in the present invention, plastic guide pieces with ribs are formed at critical or predetermined portions on the rack walls to retain the frozen products between the ribs, and the rack wall surfaces are located away from the surfaces of the frozen products.

The plastic guide pieces are disposed only at critical portions necessary to guide the products, rather than on the entire surface of the rack wall. Thus, this arrangement reduces the production cost of the machine.

Also, it simultaneously causes ice formation on the rack, not the guide pieces, as a result of moisture entering from the outside, which concentrates around the rack walls made of a steel sheet with higher thermal conductivity and larger ice accretivity, resulting in less ice accumulation on the guide pieces directly contacting with the products. Thus, the rack wall surface between the guide pieces is kept away from the surface of the frozen products, so that ice formed in these parts does not affect the products.

DETAILED DESCRIPTION OF PREFERRED EMBODIMENT

Figure 1:
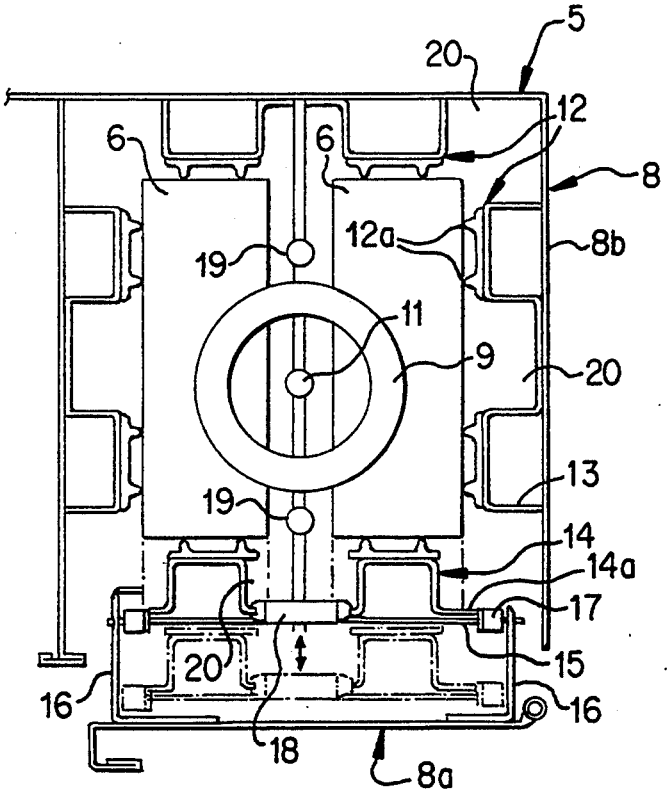
FIG. 1 is a cross section view of a shelf for accommodating products according to an embodiment of the present invention.
Figure 2:
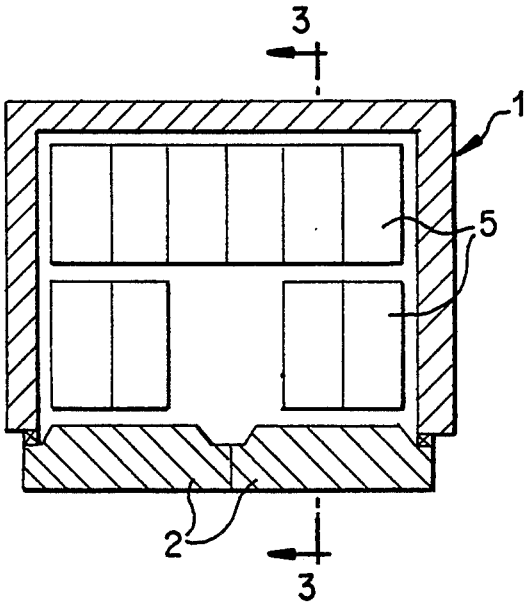
FIG. 2 is a horizontal cross section view of a refrigerator with the shelves for accommodating products in FIG. 1.
Figure 3:
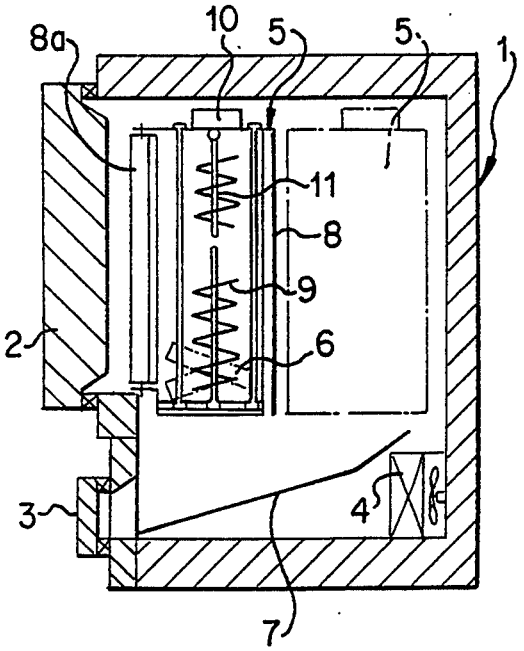
FIG. 3 is a cross section view taken along line 3—3 in FIG. 2.

Explanations are made hereinunder for an embodiment of the invention for an automatic ice-cream vending machine with reference to FIGS. 1 through 3.

First, in FIGS. 2 and 3, a refrigerator (1) constructed with heat-insulating walls includes a product-filling door (2) and a product-removal door (3) at the front side thereof. Meanwhile, the refrigerator interior is kept at about −20° C. by means of a cooler (4) that incorporates an evaporator operating at freezing cycles.

A plurality of product-accommodating shelves (5) is housed in the refrigerator (1) along its depth and its width, wherein when the products (6) are sold, the products (6) filled in each product-accommodating shelf (5) through the door (2) are dropped one by one into a chute (7), and are delivered into a product outlet, not shown, through the product-removal door (3). The product (6) in this case is an ice cream wrapped and sealed with polyester film or the like. The refrigerator (1) is disposed in an automatic vending machine, which is not shown.

The product-accommodating shelf (5) is of a well known spiral wire type. A spiral wire (9) is disposed vertically at the center of a square hollow rack (8) made of a steel sheet, in which a large number of the products (6) is stacked to be sandwiched between pitches or spaces of the spiral wire (9). The spiral wire (9) is attached to a rotating shaft (11) driven by a motor (10), and drops ice cream bags (6) located on the right and left sides from the bottom alternately when the rotating shaft (11) is turned half at one sale. The rack door (**8*a*) on the front of the rack (8) can be opened and closed to load new products (6**).

The inside structure of the product-accommodating shelf (5) is explained in more detail with reference to FIG. 1. As shown in FIG. 1, the products (6) sandwiched by the spiral wire (9) on both sides are guided by guide pieces (12), each having two rows of ribs (**12*a***). The products are guided at one point on each of the front and back ends and at two points on one side thereof.

The guide pieces (12), which are made of plastic (PVC), extend vertically along the spiral wire (9). The guide pieces (12) at the rack body side (**8*b*) are fixed onto fitting supports (13), and the guide pieces (12) at the rack door side (8*a*) are fixed onto fitting supports (14**).

The fitting supports (13) are made of a steel sheet folded to form a square concave shape as illustrated in the drawing, and are fixed on both right and left side walls and the rear wall of the rack body (**8*b*) by welding or some other means. The fitting supports (14) have the same structures as above, except that the flanges (14*a*) are folded on both sides of the supports (14), which are suspended on a pair of supporting plates (16) fixed on the right and left sides of the rack door (8*a*) by two upper and lower supporting wires (15) passing through the flanges (14*a***).

Both ends of the supporting wire (15) have collars (17) made of nylon to separate the flanges (**14*a*) from the supporting plates (16**). Two windows for allowing a hand to enter are opened at the upper and lower positions between the fitting supports (14), each having a rubber handle (18).

The supporting plate (16) is provided with gate-shaped guide grooves on front and rear portions, wherein both ends of the supporting wire (15) are supported. The position of the fitting support ( 14 ) can be changed between a position indicated by the solid lines and a position indicated by the chain lines in the FIG. 1 while sliding the supporting wires (15) back and forth in the guide grooves by holding the handle (18). This arrangement allows the position of the rack (8) to be changed according to the product sizes.

Guide rods (19) for guiding the sides of the products (6) are disposed vertically in the front and rear sides of the spiral wire (9).

In the above structure, ice can easily accumulate on various parts of the rack (8) as a result of ingress of moisture of outside air when the products are loaded onto the shelves. This, in turn, may cause the wrapping to be broken or the products to be deformed when they are removed. However, ice is formed more quickly and largely on the steel sheet parts than on the plastic parts, as described earlier.

Therefore, in the structure illustrated in the drawings, the plastic guide pieces (12) are disposed at the portions directly contacting the products (6) on the rack (8). However, these guide pieces are located on only several locations sufficient to hold the products, rather than on the entire surfaces of the walls of the rack (8), as shown in the drawings. Therefore, the cost of these guide pieces (12) can be kept low.

Moreover, ice can form easily on the steel parts between the guide pieces (12), but the wall surface of the rack (8) is kept away from the surface of the products (6) by the fitting supports (13) and (14), where ice deposition spaces (20) are formed. Therefore, ice can accumulate mostly in these spaces (20), and because these spaces are large, the products (6) are less affected even if ice accumulates there.

A bag for the product (6) can often be sealed with air during the automatic wrapping operation. If the bag inflates because of air, these spaces (20) can serve as a relief space for the bag.

The guide rods (19) press or hold the products (6) when the spiral wire (9) turns to thereby prevent the products from rotating together with the spiral wire. Disposing two rods in the front and rear sides of the spiral wire makes it possible to surely prevent flexible products, such as two-piece ice cream packs, from rotating.

The collar (17) mounted on the supporting wire (15) to support the fitting support (14) blocks the formation of ice to span over the fitting support (14) and the supporting plate (16), and avoids the difficulty usually involved in changing the positions of the fitting support (14) due to ice accumulation. Also, since the handle (18) is made of rubber, it does not freeze.

As described above, according to the present invention, the plastic guide pieces with ribs are disposed at critical or predetermined portions on the rack walls to retain frozen products, and the rack wall surface between the guide pieces is kept away from the surface of the frozen products. Thus, the cost increase resulting from the use of guide pieces can be minimized, and ice formed in the rack can be concentrated in the spaces between the guide pieces so that even products packed in soft bags can be sold safely without bag breakage or product deformation.

While the invention has been explained with reference to the specific embodiment of the invention, the explanation is illustrative, and the invention is limited only by the appended claims.

What is claimed is:

1. A shelf for housing frozen products in an automatic frozen-product vending machine, comprising:

a rack made of metal and having a rack wall surface, a plurality of fitting supports fixed to the rack wall surface to define a space for the frozen products, and plastic guide pieces fixed to the fitting supports at sides facing the space, said guide pieces having ribs to directly contact with the frozen products to guide the same, and being located away from the rack wall surfaces so that ice accumulated on the rack wall surface does not contact and interfere with the frozen products.

2. A shelf according to claim 1, wherein each fitting support is made of metal and has a hollow portion therein so that the plastic guide piece fixed to the fitting support is located away from the rack wall surface to allow ice to accumulate at a portion other than the plastic guide piece.

3. A shelf according to claim 2, further comprising guide rods located in a middle of the space to divide the space laterally so that the frozen products are stacked vertically and side by side in the space.

4. A shelf according to claim 3, further comprising a spiral wire situated in a middle of the space, said frozen products being held by the spiral wire.

5. A shelf according to claim 3, wherein said rack includes a rack door having supporting plates, at least one of the fitting supports being disposed on the supporting plates to adjust depth of the space for the frozen products.

* * * * *